US005504946A

United States Patent [19]

Keshiro

[11] Patent Number: 5,504,946

[45] Date of Patent: Apr. 9, 1996

[54] LAVATORY SEAT CLEANING APPARATUS

[76] Inventor: Rashidi A. O. Keshiro, 8 Ian Court, 2 Dacres Road, Forest Hill, London SE23 2PB, England

[21] Appl. No.: 313,457

[22] Filed: Sep. 27, 1994

[30] Foreign Application Priority Data

Sep. 28, 1993 [GB] United Kingdom ..... 9319963
May 31, 1994 [GB] United Kingdom ..... 9410850

[51] Int. Cl.[6] ..... A47K 13/00
[52] U.S. Cl. ..... 4/233; 15/246
[58] Field of Search ..... 4/233; 15/246

[56] References Cited

U.S. PATENT DOCUMENTS 3,599,246 8/1971 Bramati ..... 4/233
3,837,018 9/1974 Haberle ..... 4/233
4,713,845 12/1987 Bono ..... 4/233

FOREIGN PATENT DOCUMENTS 0066377 12/1892 Germany ..... 4/233
0510241 10/1930 Germany ..... 4/233

*Primary Examiner*—Robert M. Fetsuga
*Attorney, Agent, or Firm*—Baker & Daniels

[57] ABSTRACT

A lavatory seat cleaning apparatus comprises cleaner pad (4, 4'), guide slot (12) engageable with the cleaning pad to guide slot the cleaning pad around an associated lavatory seat (2) in engagement therewith, and a knob (9) for moving the cleaner pad along the guide slot.

14 Claims, 3 Drawing Sheets

1/3

LAVATORY SEAT CLEANING APPARATUS

BACKGROUND OF THE INVENTION

This invention relates to a lavatory seat cleaning apparatus, and to a lavatory seat cover incorporating such a cleaning apparatus.

Lavatory seats, particularly those of public lavatories, are susceptible to harbouring germs, and hence constitute a risk of spreading diseases. A known way of reducing this risk is to provide disposable cover sheets made of absorbent paper in public lavatories, a user placing one of these cover sheets on the lavatory seat prior to use, and throwing the cover sheet away after use. The main disadvantage of this method is its expense. It is also unreliable, as many people do not like using cover sheets of this type.

The aim of the invention is to provide a simple, inexpensive and reliable apparatus for cleaning a lavatory seat.

SUMMARY OF THE INVENTION

The present invention provides a lavatory seat cleaning apparatus comprising cleaner pad means, guide means engageable with the cleaning pad means to guide the cleaning pad means around an associated lavatory seat in engagement therewith, and manually-operable operating means for moving the cleaner pad means along the guide means.

The present invention also provides a lavatory seat cover provided with cleaning apparatus as defined above, wherein the cleaning pad means is constituted by a cleaner pad mounted on a support arm, and wherein the guide means is constituted by a slot formed in the cover, the slot forming a guide for the support arm whereby the pad can be moved over the surface of the associated lavatory seat by manually moving the support arm along the slot.

Advantageously, a handle provided at the free end of the support arm constitutes the manually-operable operating means.

Preferably, the handle is rotatably mounted on the support arm, and the pad is detachably fixed to a support fixed to the support arm for rotation therewith. Conveniently, the pad is generally cylindrical, and the slot is positioned so as to be spaced from, but closely track, the perimeter of the cover over that portion thereof that, in use, overlies the lavatory seat. The slot is spaced from the perimeter of the cover such that, in use, the edge of the support engages the inside surface of a downwardly-depending rim formed at the perimeter of the cover, whereby, as the support arm is moved along the slot, the edge of the support engages said inside surface of the rim thereby causing the support and the pad to rotate relative to the handle. Advantageously, a ring of serrations is positioned on said inside surface of the rim for engagement with the periphery of the support which is also serrated.

Preferably, the pad is supplied with a cleaning fluid such as a mild antiseptic. Conveniently, the pad is impregnated with the cleaning fluid, Alternatively, the pad is supplied with cleaning fluid contained in a reservoir formed within the respective support.

In a preferred embodiment, the cleaning pad means further comprises a second pad, a second support arm, a second support and a second handle, all of which have the features defined above, the second support arm also engaging within the slot.

BRIEF DESCRIPTION OF THE DRAWINGS

A lavatory seat cover, incorporating a lavatory seat cleaning apparatus constructed in accordance with the invention, will now be described in greater detail, by way of example, with reference to the accompanying drawings, in which.

DETAILED DESCRIPTION OF PREFERRED EMBODIMENTS

Figure 1:
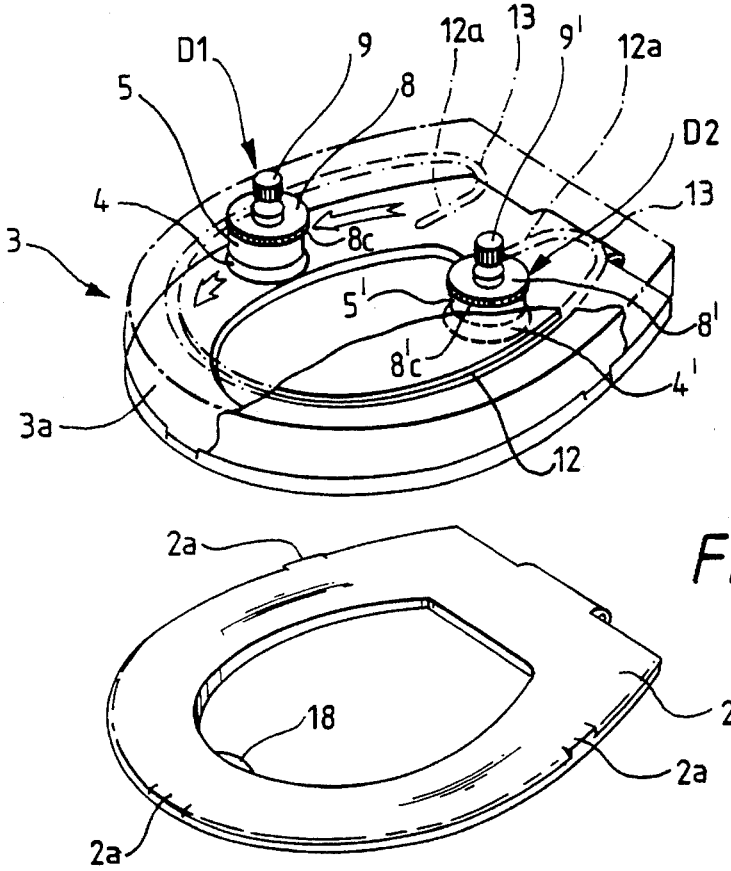
FIG. 1 is a perspective view of the cover, partially cut-away to show the cleaning apparatus, and an associated lavatory seat.
Figure 2:
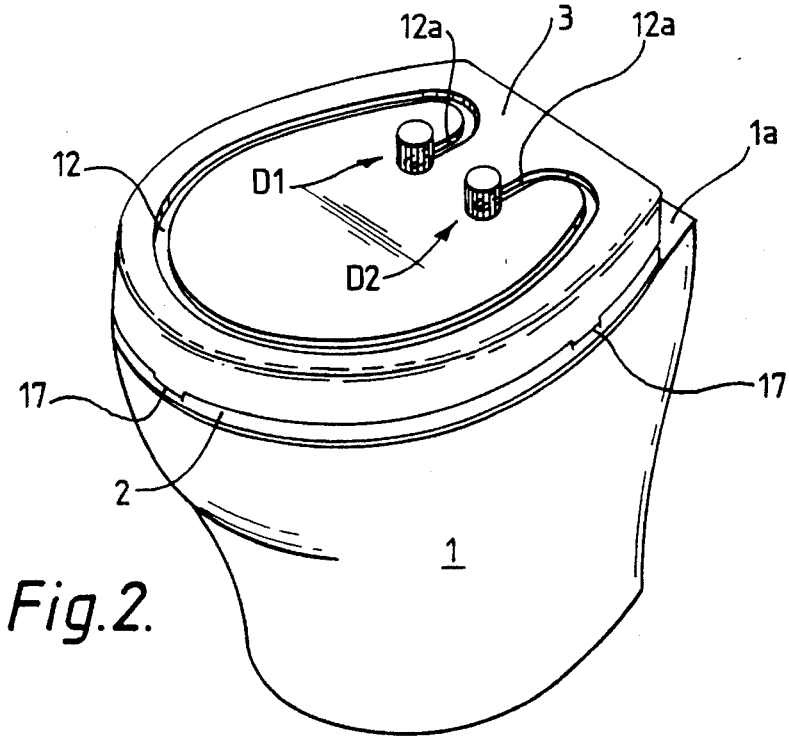
FIG. 2 is a perspective view of a lavatory incorporating the cover and the seat of FIG. 1.
Figure 3:
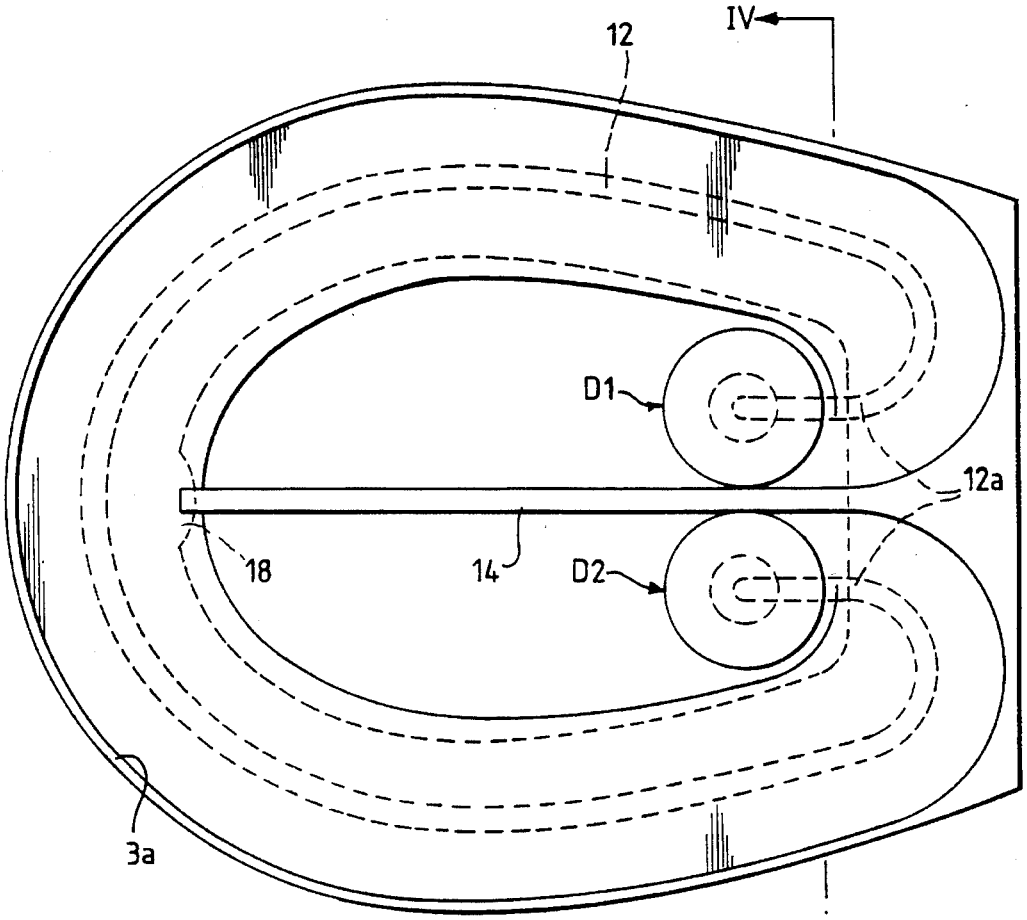
FIG. 3 is a plan view of the cover, showing the tracks which guide the cleaning pads of the apparatus.

Referring to the drawings, FIG. 2 shows a lavatory having a lavatory pan 1, a lavatory seat 2 and a lavatory seat cover 3. Both the seat 2 and the cover 3 are made of ABS (acrylonitrile butadine styrene), and are pivotally mounted to the rear edge la of the lavatory pan 1 by hinges (not shown) in a conventional manner. Thus, the cover 3 can pivot between a generally upright position and a generally horizontal position in which it overlies the seat 2.

The cover 3 is generally oval in shape, having a length of about 17½ inches and a width of about 12½ inches. The cover 3 is formed with a downwardly-depending rim 3*a* at its perimeter. The rim 3*a* has a depth of about 2½ inches and houses a lavatory seat cleaning apparatus constituted by two cleaning devices D1 and D2

Figure 6:
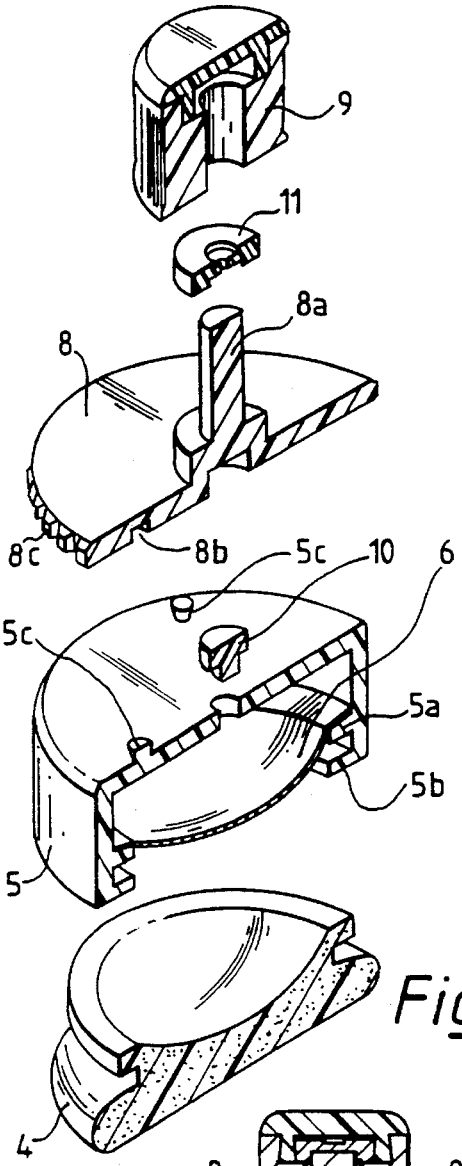
FIG. 6 is an exploded perspective view of the cleaning device of FIG. 5.
Figure 5:
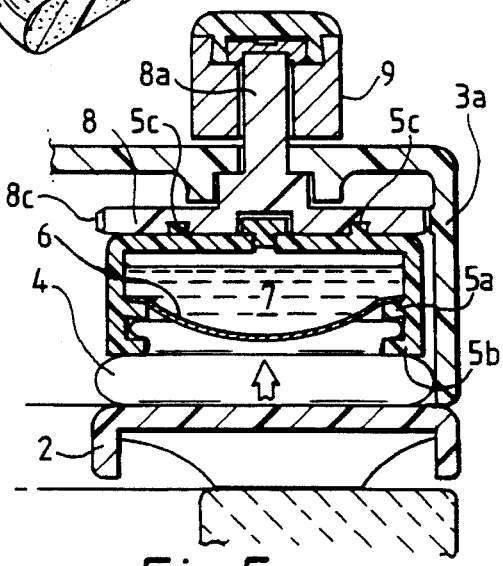
FIG. 5 is a vertical cross-section taken through the cover and one of the cleaning devices constituting the cleaning apparatus.

As shown in FIGS. 5 and 6, the device D1 includes a generally cylindrical cleaning pad 4 which is made of a foamed material such as polyethylene. The pad 4 is mounted within a hollow cylindrical support 5 by means of a flange 4*a* which is a snap fit between a pair of shoulders 5*a* and 5*b* formed within the support. A perforated diaphragm 6 is supported on the upper shoulder 5*a* within the support 5. The support 5 and the diaphragm 6 are made of ABS. The interior of the support 5 above the diaphragm 6 constitutes a reservoir 7 containing an odourless, biodegradable, antiseptic cleaning fluid. The support 5 is mounted on a generally circular support plate 8 which in turn is formed with an upwardly-projecting, central shaft 8*a*. As shown, the top surface of the support 5 is formed with three plugs 5*c* which, in use, snap-engage within complementary sockets 8*b* formed in the support plates 8. The circumferential edge of the support plate 8 is formed with serrations 8*c*. A manually-operable operating means or handle (knob) 9 is rotatably mounted at the free end of the shaft 8*a*. Respective washers 10 and 11 are positioned between the top surface of the support 5 and the support plate 8, and between the free end of the shaft 8*a* and the handle 9.

Figure 7:
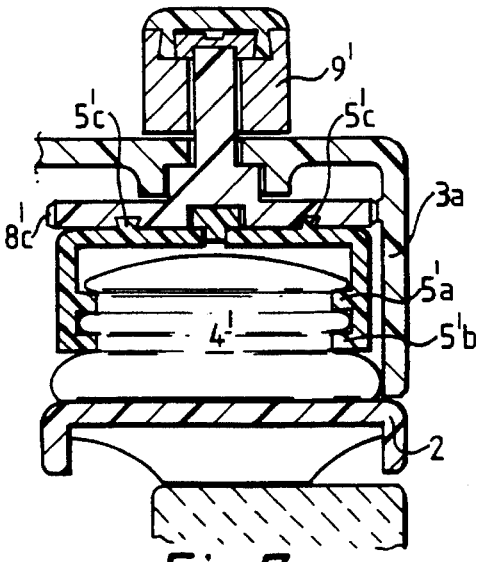
FIG. 7 is a vertical cross-section taken through the cover and the other cleaning device.

The cleaning device D2 (see FIG. 7) is similar to the device D1, and so like reference numerals (but primed) will be used for like parts, and only the differences will be described. Thus, the device D2 is not provided with a diaphragm or a fluid reservoir. Instead, its pad 4' is of increased size, and is formed with a pair of flanges 4'*a* and 4'*b*. The flange 4'*a* snap fits between the shoulders 5'*a* and 5'*b*, and the flange 4'*b* snaps over the upper shoulder 5'*a*.

The main surface of the cover 3 is formed with a guide means or slot 12 which is positioned about 1½ inches from, and closely tracks, the perimeter of the cover between points 13 adjacent to the rear edge. The slot 12 also extends inwardly from each of the points 13, to define a pair of parallel slot portions 12*a*. The slot 12 is sized to be slightly wider than the shafts 8*a*, 8'*a* so that the pads 4, 4' can be positioned within the rim 3*a*, with their shafts passing through the slot 12, and with the handles 9, 9' resting on top of the cover 3. In the region of the slot portions 12*a*, the inside surface of the cover 3 is formed with a central reinforcing rib 14. A protective moulding 15 is screwed to the rib 14 to provide a housing for the pads 4, 4' when they are not in use.

Figure 4:
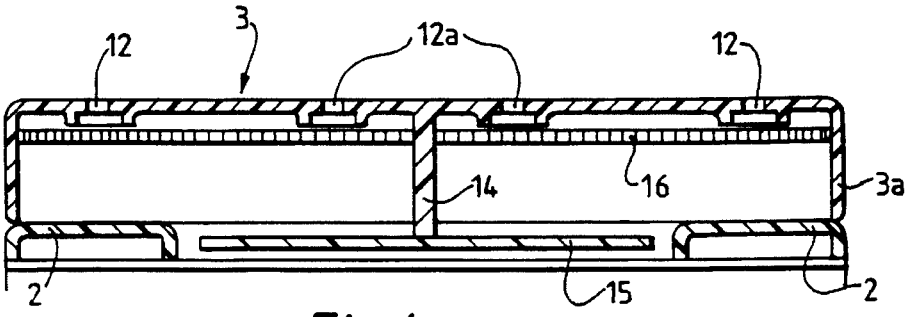
FIG. 4 is a cross-section taken on the line IV—IV of FIG. 3.

The rim 3*a* of the cover 3 is slightly thicker than the rest of the cover, and its inner surface is provided with a serrated track 16 (see FIG. 4) which is engageable with the serrations 8*c*, 8'*c* of the support plates 8, 8' of the devices D1 and D2. The cover 3 is also formed with three stop members 17 (see FIG. 2) which, when the cover is in its generally horizontal position overlying the lavatory seat 2, fit within recesses 2*a* formed in the upper surface of the seat, thereby ensuring that the pads 4, 4' are free to move over the upper surface of the seat, as is described below.

In use, the cover 3 is lowered into position on top of the lavatory seat 2 until the front end portion of the reinforcing rib 14 rests on a tab 18 projecting inwardly from the front inner perimeter of the seat. In this position, the devices D1 and D2 are positioned so that the pads 4, 4' are housed within the moulding 15, with the shafts 8*a*, 8'*a* projecting through the slot portions 12*a*. The device D1 is then moved by its handle 9 so that its shaft 8*a* is forced along the slot portion 12*a* and then round the slot 12. As the shaft 8*a* moves along the slot 12, the serrated edge 8*c* of the support plate 8 engages the serrated track 16, thereby causing the support plate and the support 5 to rotate with respect to the handle 9. This rotation of the support 5 causes the pad 4 to rotate over and against the upper surface of the lavatory seat 2. The downwards pressure on the handle 9 is transferred via the support plate 8, the support 5 and the pad 4 to the "fixed" surface of the seat 2, which results in upward pressure of the pad against the diaphragm 6, thereby releasing drops of cleaning fluid through the perforations in the diaphragm. Thus, as the pad moves over the seat 2, it cleans its upper surface. The device D1 is moved round the slot 12 until it reaches the point 13 positioned at the entry to the slot portion 12*a* which houses the device D2. The device D1 is then returned to its starting position, thereby subjecting the upper surface of the lavatory seat 2 to a second cleaning operation. If necessary, this sequence of operations can be repeated one or more times. If several such cleaning operations are necessary, the device D1 will be moved backwards and forwards between the two points 13, rather than being positioned in its slot portion 12*a* each time. After the last cleaning operation, however, the device D1 is repositioned in its slot portion 12*a* with its pad 4 housed within the protective moulding 15.

The device D2 (whose pad 4' is a dry foam pad) is then used to dry the upper surface of the lavatory seat 2. This is accomplished by moving the device D2 using its handle 9' along the slot portion 12*a*, and then round the slot 12 in both directions. Here again, engagement of the serrated edge portion 8'*c* of the support plate 8' with the serrated track 16 causes the pad 4' to rotate over and against the upper surface of the lavatory seat 2, thereby effecting a drying operation. Again, if necessary the drying operation can be repeated one or more times. When drying is complete, the device D2 is returned to its starting position, with the shaft 8'*a* within the slot portion 12*a* and with the pad 4' housed within the protective moulding 15.

As an alternative to the pad 4 being associated with a reservoir containing cleaning fluid, the pad could be impregnated with the cleaning fluid. In this case, the pad 4 would be the same size and shape as the pad 4'.

Figure 8:
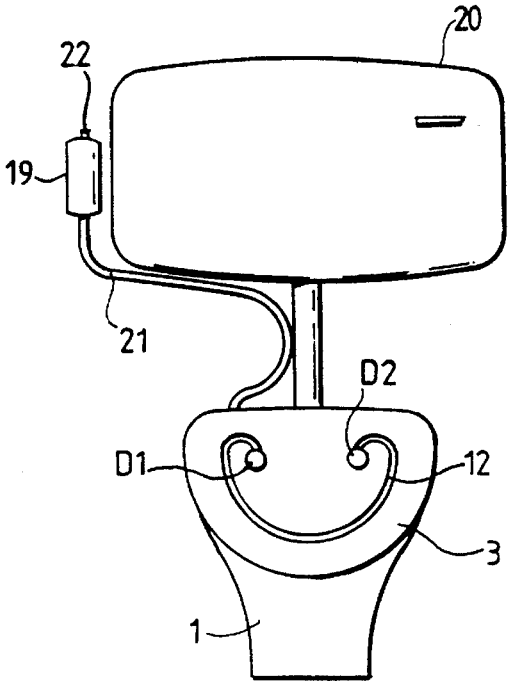
FIG. 8 is a perspective view of a lavatory incorporating a modified form of the cover of FIGS. 1 to 7.

FIG. 8 shows a further alternative way of supplying cleaning fluid. Here, cleaning fluid is contained in a pressurised container 19 fixed to the side of a cistern 20 associated with the lavatory pan 1. In this case, cleaning fluid is channelled from the pressurised container 19 to the upper surface of the lavatory seat 2 via a flexible hose 21. The flexible hose 21 passes through an aperture in (not shown) in the back of the lavatory seat cover 3 so that the free end of the hose is positioned adjacent to the path of movement of the device D1. Thus, when the pressurised container 19 is activated by a button 22, a metered dose of cleaning fluid is directed through the hose 21 and onto the upper surface of the lavatory seat 2. The device D1 is then moved by its handle 9 back and forth along the slot 12, thereby subjecting the upper surface of the lavatory seat 2 to a cleaning operation.

It will be apparent that the lavatory seat cleaning apparatus described above could be modified in a number of other ways. Thus, the size of the pads 4, 4' could be varied to complement the size and shape of any associated lavatory seat. Moreover, the cleaning apparatus of the invention could be used with any size or shape of lavatory pan/seat, in which case the cover 3 containing the cleaning apparatus would be shaped to complement the associated lavatory seat.

In an alternative embodiment, three cleaner pads are provided, and the cleaning apparatus is operated by means constituted by a central boss and a plurality of support arms, each support arm being attached to a respective one of the cleaner pads. In this case, the operating means is further constituted by an operating arm associated with the central boss, whereby movement of the operating arm causes the boss to rotate about it axis, the boss carrying the support arms and the cleaning pads therewith. The boss, the support arms and the operating arm are made of ABS (acrylonitrile butadine styrene), and the cleaning pads are made of a foam material such as polyethylene.

This form of cleaning apparatus further comprises a container of a cleaning fluid such as a mild antiseptic, the container having an aperture in its upper surface. A roller is mounted in said aperture for rotation relative thereto, the roller being positioned to extend partially into the interior of the container so that movement of a cleaner pad over that portion of the roller which protrudes from the container causes the roller to rotate and transfer fluid from the interior of the container to that pad.

In this case, the lavatory seat cover is provided with the guide means constituted by an endless guide rail provided within a rim formed at the peripheral edge of the cover. Each cleaner pad is provided with clips which snap engage over the guide rail.

The central boss extends through an aperture in the cover in such a manner that the boss is rotatable relative to the cover but is axially fixed thereto. In this case, the operating arm is positioned on the outside of the cover, with the support arms and cleaner pads positioned within the cover.

I claim:

1. In combination, a lavatory seat, a cover for said lavatory seat, a cleaning apparatus for cleaning said lavatory seat including a cleaning device, guide means on said cover engaged with the cleaning device to guide the cleaning device around the lavatory seat, and manually-operable operating means for moving the cleaning device along the guide means, said cleaning device including a first pad mounted on a support, said guide means being constituted by a slot formed in the cover, the slot forming a guide for the support whereby the pad can be moved over the surface of the associated lavatory seat by manually moving the support along the slot, said slot being spaced from a perimeter of the cover, an edge of the support engages the inside surface of a downwardly-depending rim formed at the perimeter of the cover, whereby, as the support is moved along the slot, the edge of the support engaging said inside surface of the rim causes the support and the pad to rotate relative to the manually-operable operating means.

2. A combination as claimed in claim 1, wherein a handle provided at the free end of the support constitutes the manually-operable operating means.

3. A combination as claimed in claim 2, wherein the handle is rotatably mounted on the support, and the pad is detachably fixed to said support for rotation therewith.

4. A combination as claimed in claim 2, wherein the pad is generally cylindrical, and the slot is positioned so as to be spaced from, but closely track, the perimeter of the cover.

5. A combination as claimed in claim 1, wherein a ring of serrations is positioned on said inside surface of the rim for engagement with the edge of the support which is also serrated.

6. A combination as claimed in claim 1, wherein the pad is supplied with a cleaning fluid.

7. A combination as claimed in claim 6, wherein the pad is impregnated with the cleaning fluid.

8. A combination as claimed in claim 6, wherein the cleaning fluid is contained in a reservoir formed within the support.

9. In combination, a lavatory seat, a cover for said lavatory seat, a cleaning apparatus for cleaning said lavatory seat including a cleaning device, guide means on said cover engaged with the cleaning device to guide the cleaning device around the lavatory seat, and manually-operable operating means for moving the cleaning device along the guide means, said cleaning device including a first pad mounted on a first support and a second pad mounted on a second support, said guide means being constituted by a slot formed in the cover, the slot forming a guide for the supports whereby the pads can be moved over the surface of the associated lavatory seat by manually moving the supports along the slot, the slot being spaced from a perimeter of the cover, an edge of each of the supports engaging the inside surface of a downwardly-depending rim formed at the perimeter of the cover, whereby, as the supports are moved along the slot, the edges of the supports engage said inside surface of the rim thereby causing the supports and the pads to rotate relative to the manually-operable operating means.

10. A combination as claimed in claim 9, wherein the manually-operable operating means includes a pair of handles provided at the free ends of the respective supports.

11. A combination as claimed in claim 10, wherein the handles are rotatably mounted on the supports and the pads are detachably fixed to said supports for rotation therewith.

12. A combination as claimed in claim 9, wherein the pads are generally cylindrical, and the slot is positioned so as to be spaced from, but closely track, the perimeter of the cover.

13. A combination as claimed in claim 9, wherein a ring of serrations is positioned on said inside surface of the rim for engagement with the edges of the supports which are also serrated.

14. In combination, a lavatory seat, a cover for said lavatory seat, a cleaning apparatus for cleaning said lavatory seat including a cleaning device, guide means on said cover engaged with the cleaning device to guide the cleaning device around the lavatory seat, and manually-operable operating means for moving the cleaning device along the guide means, said cleaning device including a first pad mounted on a support, said guide means being constituted by a slot formed in the cover, the slot forming a guide for the support whereby the pad can be moved over the surface of the associated lavatory seat by manually moving the support along the slot, and a pressurised container of cleaning fluid, and a flexible hose for feeding cleaning fluid from the pressurised container to a position within the cover overlying the associated lavatory seat.

* * * * *